US006532867B2

(12) United States Patent
Nakamura et al.

(10) Patent No.: US 6,532,867 B2
(45) Date of Patent: Mar. 18, 2003

(54) METHOD FOR PRODUCING A STENCIL PLATE

(75) Inventors: Jun Nakamura, Ibaraki-ken (JP); Shoichi Ikejima, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 39 days.

(21) Appl. No.: 09/858,910

(22) Filed: May 17, 2001

(65) Prior Publication Data

US 2002/0037392 A1 Mar. 28, 2002

(30) Foreign Application Priority Data

May 19, 2000 (JP) ..... 2000-148951
Apr. 24, 2001 (JP) ..... 2001-126015

(51) Int. Cl.[7] ..... B41C 1/14
(52) U.S. Cl. ..... 101/128.21
(58) Field of Search ..... 101/127, 128.21, 101/128.4; 400/120.09, 120.13; 347/188, 193, 221; 428/131, 137, 195

(56) References Cited

U.S. PATENT DOCUMENTS 5,243,906 A * 9/1993 Okusawa ..... 101/128.21
5,384,585 A * 1/1995 Okumura ..... 101/128.4
5,522,313 A * 6/1996 Okusawa ..... 101/128.21
5,559,546 A * 9/1996 Sato ..... 347/200
5,617,787 A * 4/1997 Takita et al. ..... 101/128.4
6,130,697 A * 10/2000 Yokoyama et al. ..... 101/128.4

FOREIGN PATENT DOCUMENTS

JP 06-320700 * 11/1994

* cited by examiner

*Primary Examiner*—Stephen R. Funk
(74) *Attorney, Agent, or Firm*—Fitch, Even, Tabin & Flannery

(57) ABSTRACT

A perforation pattern is provided with a stencil plate, which is decreased in perforation configuration irregularity and has an adequate size of perforations. The stencil plate is produced from a heat sensitive stencil sheet having a heat shrinkable film by selectively heating the film with a heating device to form independent dot perforations corresponding to an image in the film, and each of the perforations has a through hole and a rim surrounding the through hole and bulging on a heated side of the film, and the rim has a height that satisfies the following formulae (1) and (2):

$$h \leqq 4(\mu m) \quad (1)$$

$$h \leqq 0.05\sqrt{(p_x p_y)}\ (\mu m) \quad (2)$$

where h denotes the height ($\mu$m) in reference to the surface of the film before heated, $p_x$ and $p_y$ respectively denote pitches ($\mu$m) in main and sub scanning directions of the heating device.

9 Claims, 5 Drawing Sheets

METHOD FOR PRODUCING A STENCIL PLATE

BACKGROUND OF THE INVENTION

1. Field of the Invention

This invention relates to a method and apparatus for producing a stencil plate from a heat sensitive stencil sheet having a film by perforating the film with a heating device such as a thermal head, and also relates to a stencil plate obtained thereby. This invention particularly relates to a perforation pattern in which size of perforations is kept adequate without application of large energy or high temperature or decline of heat transfer efficiency in the stencil plate making device. The perforation pattern also decreases perforation configuration irregularity that would locally occur at random or depending on image pattern, and further prevents a molten resin of the film from adhering to heating elements of the thermal head.

2. Description of Related Art including information disclosed under 37 CFR 1.97 and 1.98

The heat sensitive stencil sheet has a thermoplastic resin film (hereinafter also called just "film") which has a nature that perforations for penetration of ink can be formed by heating with a heating device such as a thermal head or laser. When the stencil sheet is used for printing, ink passes through the perforations and is transferred onto paper. Various materials are proposed hitherto for the film. For example, JP-A-41-7623 proposes polypropylene, polyamides, polyethylene, and vinyl chloride vinylidene chloride copolymers; JP-A-47-1184 proposes propylene copolymers; JP-A-47-1185 proposes chlorinated polyvinyl chloride; JP-A-47-1186 proposes high crystalline polyvinyl chloride; JP-A-49-6566 proposes propylene α-olefin copolymers; JP-A-49-10860 proposes ethylene vinyl acetate copolymer; JP-A-51-2512 proposes acrylonitrile resins, JP-A-51-2513 proposes polyethylene terephthalate; Japanese Patent No. 1,669,893 proposes polyvinylidene fluoride; and Japanese Patent No.2,030,681 proposes polyethylene naphthalate copolymers. Among them, films that are presently used for heat sensitive stencil sheets on the market are heat shrinkable films obtained by biaxially stretching a polyethylene terephthalate film or vinylidene chloride copolymer film, mainly for reasons of perforation sensitivity (i.e., performance to give sufficiently large perforations with small quantity of heat) and machine suitability (i.e., unlikelihood to cause wrinkling, loosening, elongation and deformation when the stencil sheet is produced into a stencil plate and used for printing). Especially for stencil printing machines which can automatically produce stencil plates and perform printing, the polyethylene terephthalate film is mainly used.

Alternatively, for forming perforations by means of heat, a film obtained by casting a resin with a low melting point may be used in place of the stretched heat shrinkable film. For example, Japanese Patent No. 1,668,117 and JP-A-62-173296 propose films obtained by casting a synthetic resin solution or emulsion, and JP-A-4-78590 proposes a cast thermoplastic resin film containing a silicone oil. In case of the cast film, it is not thermally shrunken, but since it is made of a resin low in melting point, it can be molten at heated portions to form perforations (hereinafter this film is called "hot-melt film").

However, at present, the hot-melt film is not practically used on the market as a heat sensitive stencil sheet. The main reasons are considered to be low perforation sensitivity, perforation configuration irregularity and low mechanical strength for printing use.

Heat shrinkable films of the heat sensitive stencil sheets currently used on the market for stencil printing machines are about 1.5 to 3 μm in thickness, and encounter no difficulty in stable forming and lamination, in contrary to hot-melt films of 10 μm or less in thickness as disclosed in the Japanese Patent No. 1,668,117 and the like.

In terms of behavior of perforation or migration of molten resins, the hot-melt film relies only on surface tension while the heat shrinkable film relies on heat shrinkage stress which is sufficiently larger than the surface tension. Therefore, the heat shrinkable film has such a higher sensitivity as to allow sufficiently large perforations to be obtained with a smaller heat quantity than the hot-melt film with the same thickness and melt viscosity.

The heat shrinkage stress of the heat shrinkable film clearly depends on a temperature, and thus perforations can be obtained faithfully to a temperature pattern formed on the film, for example, by the heating elements of a thermal head. On the other hand, in case where a hot-melt film is heated and perforated due to surface tension, the temperature pattern of heating elements cannot be accurately reflected by the perforation configuration. The reason is that when resins lowered in viscosity due to melting migrate in accordance with surface tension, it does not always migrate toward low temperature portions far away from the center of each heating element, but can be concentrated near fibers of substrates or can flow irregularly due to a shear caused by its motion relative to the heating element. Therefore, even if a heat sensitive stencil sheet using a hot-melt film is processed into a stencil plate with an opening ratio suitable for printing conditions, uniform perforations are hardly obtained. That is, microscopically, large perforations and small perforations exist together, and it is hard to obtain uniform density, for example, in a solid printed portion of an image.

Furthermore, though the hot-melt films are composed of resins of a low melting point, they must be heated by heating elements to a temperature very higher than the heat shrinkable film, in order to sufficiently induce the migration of the resins with surface tension in very small areas (e.g., pixel density of 300 to 600 dpi) and in a short time (e.g., sub scanning period ranging from 2 to 4 ms) that are ordinary stencil plate making conditions of stencil plate making devices installed in current stencil printing machines. This causes the heating elements to be deteriorated due to overheat.

Moreover, during printing, the heat sensitive stencil sheet is stressed due to shear with printing paper in the rotating direction of printing drum. A heat sensitive stencil sheet having a cast hot-melt film is generally lower in elastic modulus and rupture strength than a heat sensitive stencil sheet having a stretched heat shrinkable film. Therefore, a heat sensitive stencil sheet having a hot-melt film is more likely to cause deformation of printed images and, as the case may be, more likely to be broken to cause stained images, compared with a heat sensitive stencil sheet having a heat shrinkable film.

For the above reasons, it can be said that heat shrinkable films are and will be mainly used as films for heat sensitive stencil sheets. Therefore, the discussion concerning heat sensitive stencil sheets is hereinafter limited to the heat sensitive stencil sheets using a heat shrinkable film.

The heat sensitive stencil sheet is usually prepared by laminating the above-mentioned film on a porous substrate in order to impart a strength necessary for avoiding elongation, wrinkling (which distorts printed image) and breaking (which stains printed images) due to forces acting when the stencil sheet is mounted to a printing machine and used for printing. The porous substrate provides a heat sensitive stencil sheet with a strength, and allows ink to penetrate through perforations after the stencil sheet has been processed into a stencil plate. It is known that materials for the porous substrate include (1) so-called Japanese paper prepared from natural fibers such as Broussonetia Kazinoki, Edgeworthia chrysantha and Manila hemp, (2) paper-like sheets prepared from regenerated or synthetic fibers of rayon, vinylon, polyester, nylon, etc., (3) mixed paper prepared by mixing the natural fibers of (1) and the regenerated or synthetic fibers of (2), and (4) so-called polyester paper prepared by hot-rolling a thin and soft sheet prepared from a mixture of polyester fibers with non-stretched polyester fibers serving as binder fibers.

A heat sensitive stencil sheet prepared by laminating a film and a porous substrate as mentioned above has a strength sufficient to endure the forces caused by printing action of printing machines, but when ink passes through the heat sensitive stencil sheet, specifically through perforations formed in the film, it can happen that the ink passes unevenly depending on dispersion state of the fibers of the porous substrate, causing printed images to be degraded in uniformity of density. In order to avoid it, a heat sensitive stencil sheet made of a single layer of film is proposed.

Methods for perforating the film of the heat sensitive stencil sheet to obtain a stencil plate include the following methods: (1) the film of the heat sensitive stencil sheet is kept in contact with an original having an image area composed of carbon, and is irradiated with infrared light, so that the film is perforated by the heat generated from the image area; (2) the film of the heat sensitive stencil sheet is kept in contact with a thermal head and is relatively moved whilst the thermal head is caused to generate heat at portions of heating elements corresponding to an original image, so that perforations are made in the film; and (3) a laser beam is modulated in accordance with an original image to scan the film of the heat sensitive stencil sheet, so that perforations are made in the film. Among the above methods, the method using infrared light is limited in kinds of originals, and cannot be used for data editing of documents and images. The method using a laser is not practically applied mainly because of the length of stencil plate making time. Therefore, at present, the method using a thermal head is mainly used.

In the stencil plate making process using a thermal head, numerous perforations two-dimensionally arranged in the main scanning direction and the sub scanning direction are formed. In this case, it is desirable that perforations are made almost equal in shape so that an opening ratio suitable for printing conditions is achieved. If the perforations are uniform in shape, microscopic ink transfer states are uniform in printed image area, particularly in solid printed portions, so that density uniformity is achieved. On the contrary, if the perforations are uneven in shape, microscopic ink transfer states are uneven, and it can happen that thin lines are blurred, that density irregularity occurs in solid printed portions, and that excessively large perforations are formed which cause partially excessive ink transfer, hence set-off. Thus, to obtain perforations uniform in shape by respective heating elements, heating elements with various forms are proposed. Japanese Patent No. 2,732,532 proposes a method of obtaining independent perforations in both the main scanning direction and the sub scanning direction by keeping the pitch in the main scanning direction equal to the pitch in the sub scanning direction, keeping the length of heating elements in the main scanning direction shorter than the length in the sub scanning direction, and keeping the length of the heating elements in the sub scanning direction shorter than the pitch in the sub scanning direction. JP-A-4-314552 proposes a method of preventing that adjacent perforations in the main scanning direction are merged with each other, by disposing cooling members made of a material having a large heat conductivity between adjacent heating elements in the main scanning direction. JP-A-6-115042 proposes a method of processing a heat sensitive stencil sheet consisting only of a thermoplastic resin film into a stencil plate using a thermal head in which the length of heating elements in the main scanning direction is kept in a range of 15 to 75% of the pitch in the main scanning direction while the length of the heating elements in the sub scanning direction is kept in a range of 15 to 75% of the pitch in the sub scanning direction.

As for perforation pattern, planar forms (such as diameter, aspect ratio and area) and statistical states (such as average and variation) of perforations only have been discussed, but rim configuration of perforations that gives a desirable ink transfer state can be seen only in the following proposals. Japanese Patent No. 2,638,390 proposes a method of obtaining independent perforations in both the main scanning direction and the sub scanning direction by specifying a relationship between four items; the length of heating elements in the main scanning direction, the length of heating elements in the sub scanning direction, the length of perforations in the main scanning direction and the length of perforations in the sub scanning direction. This patent describes that perforations possess rims. JP-A-6-320700 proposes a perforation method comprising the steps of heating a heat sensitive stencil sheet consisting essentially of a film using a first thermal head from one side thereof and subsequently heating it from the other side thereof using a second thermal head. This patent describes that perforations possess sectional profiles. JP-A-8-20123 proposes a method of making a stencil plate from a heat sensitive stencil sheet consisting essentially of a 3.5 $\mu$m or thicker thermoplastic resin film only, in which perforations are formed to be conical in sectional form, with the dimensions of the conical section specified in relation with the pitch in the main scanning direction, in order to eliminate perforation shape irregularity caused by the substrate of the heat sensitive stencil sheet.

The above Japanese Patent No. 2,732,532, JP-A-4-314552, and JP-A-6-115042 may be useful for preventing expansion of perforations caused by merging of adjacent perforations and for making perforations uniform in shape, so that a desirable ink transfer state is realized. However, since perforation behavior of stencil sheets depends on physical properties of films, they cannot be said to be the best methods for controlling the shape of perforations with diverse heat shrinkable films.

Furthermore, though said Japanese Patent No. 2,638,390 and JP-A-6-320700 deal with rims and sectional profiles of perforations, they simply refer to existence of such features of perforations, but do not suggest any influence of the rims and the sectional profiles of perforations on the perforation configuration, or any method for inhibiting decline of heat transfer efficiency or method of achieving perforation configuration uniformity.

Moreover, the stencil plate making method described in said JP-A-8-20123 specifies, as described above, the relation between the dimensions of the conical section and the pitch in the main scanning direction, but it is a method of making a stencil plate from a heat sensitive stencil sheet consisting only of a thick thermoplastic resin film without any porous substrate. However, such a heat sensitive stencil sheet is presently not available as a commercial product, and has various other problems than irregularity of perforation shape. Furthermore, the document does not refer to general heat sensitive stencil sheets including the conventional type consisting of a thermoplastic resin film and a porous substrate in terms of sectional form of perforations formed therein, and does not disclose either a finding that the sectional form and height of rims affect heat transfer efficiency and perforation configuration irregularity.

In the case where it is intended to form through holes with a certain size in a stencil sheet, the resin in each portion to be perforated by a thermal head migrates to the rim portion surrounding each through hole, but it can happen that, depending on, for example, thermal physical properties of the film of the heat sensitive stencil sheet and heating conditions of heating elements of the thermal head, the resin accumulated in the rim portion is often formed as a large bulging from a heated surface of the film.

The bulging portions are kept between the heated surface of the film and the heating elements of the thermal head and act to keep the heated surface of the film and the heating elements farther away from each other. As a result, the efficiency of heat transfer from the heating elements to the film is greatly lowered, making it difficult to form the through holes with a desired size. In the case where the size of the through holes does not reach the desired value, prints become insufficient in density. If it is attempted to achieve the desired size by intensifying the energy applied to the heating elements of the thermal head, the heating elements may be damaged.

On the other hand, the distance between the heated surface of the film and the heating elements necessitated by the formed bulging is different between a solid printed area having numerous perforations and an area adjacent to a non-image area having no perforation. So, the above decline of heat transfer efficiency depends upon an image rate and causes density irregularity in prints. Furthermore, since the bulging portions of rims are kept in pressure contact with the heating elements of the thermal head and transported while being shorn, the planar forms of rims of perforations, i.e., the shape of through holes are distorted, thereby causing microscopic density irregularity and lowering reproducibility of patterns such as characters in prints. In the case where the shape of through holes are remarkably distorted, the through holes of adjacent perforations are merged with each other, and from the thus-formed large through holes, excessive quantities of ink is transferred to paper, causing set-off or the like.

Moreover, it can also happen that the resin of the film deformed by the above shearing comes off to be deposited at a position downstream of the heating elements of the thermal head, and the deposit makes the heating elements and the film kept still farther away from each other, thereby greatly lowering stencil plate making performance.

It is known that these undesirable phenomena are attributable, for example, to the thermal physical properties of the film and the heating conditions of the heating elements of the thermal head, but their relation with the height of the rims bulging around the through holes of perforations has never been discussed. Moreover, no particular finding has been obtained on the factors that determine perforation shapes including the rim of each perforation, necessitating trials and errors.

This invention solves this problem. The object of this invention is to provide a perforation pattern that can keep the size of perforations adequate without requiring large energy application and high temperature in the stencil making device while inhibiting the decline of heat transfer efficiency due to the influence of rims, decreases the perforation configuration irregularity that has locally occurred at random or depending on image pattern, and further prevents the resin of the film from adhering to the heating elements.

BRIEF SUMMARY OF THE INVENTION

The inventors have intensively studied perforation behavior of heat sensitive stencil sheets to achieve the above object, and as a result, found that if perforations are formed to ensure that the height of rims conforms to certain conditions in relation with the pitch between adjacent perforations, perforation configuration irregularity can be inhibited to provide good prints, irrespectively of the thickness and melting point of the film.

According to the first aspect of this invention, there is provided a method for producing a stencil plate, which comprises providing a heat sensitive stencil sheet having a heat shrinkable film, and selectively heating said film with a heating device to form independent dot perforations corresponding to an image in said film, so that each of said perforations has a through hole and a rim surrounding said through hole and bulging on a heated side of said film, and said rim has a height that satisfies the following formulae (1) and (2):

$$h \leqq 4(\mu m) \quad (1)$$

$$h \leqq 0.05\sqrt{(p_x p_y)}(\mu m) \quad (2)$$

where h denotes said height ($\mu$m) in reference to the surface of the film before heated, $p_x$ denotes a pitch ($\mu$m) in a main scanning direction of said heating device, and $p_y$ denotes a pitch ($\mu$m) in a sub scanning direction of said heating device.

According to the second aspect of this invention, there is provided an apparatus for producing a stencil plate from a heat sensitive stencil sheet having a heat shrinkable film, comprising a heating device which selectively heats said film to form independent dot perforations corresponding to an image in said film, so that each of said perforations has a through hole and a rim surrounding said through hole and bulging on a heated side of said film, and said rim has a height that satisfies the following formulae (1) and (2):

$$h \leqq 4(\mu m) \quad (1)$$

$$h \leqq 0.05\sqrt{(p_x p_y)}(\mu m) \quad (2)$$

where h denotes said height ($\mu$m) in reference to the surface of the film before heated, $p_x$ denotes a pitch ($\mu$m) in a main scanning direction of said heating device, and $p_y$ denotes a pitch ($\mu$m) in a sub scanning direction of said heating device.

According to the third aspect of this invention, there is provided a stencil plate which comprises a heat shrinkable film having independent dot perforations corresponding to an image, said perforations being formed by selectively heating said film with a heating device, wherein each of said perforations has a through hole and a rim surrounding said through hole and bulging on a heated side of said film, and said rim has a height that satisfies the following formulae (1) and (2):

$$h \leqq 4(\mu m) \quad (1)$$

$$h \leqq 0.05\sqrt{(p_x p_y)}(\mu m) \quad (2)$$

where h denotes said height ($\mu$m) in reference to the surface of the film before heated, $p_x$ denotes a pitch ($\mu$m) in a main scanning direction, and $p_y$ denotes a pitch ($\mu$m) in a sub scanning direction.

According to the fourth aspect of this invention, there is provided a stencil sheet which comprises a heat shrinkable film destined to have independent dot perforations corresponding to an image by selectively heating said film with a heating device, so that each of said perforations has a through hole and a rim surrounding said through hole and bulging on a heated side of said film, and said rim has a height that satisfies the following formulae (1) and (2):

$$h \leqq 4(\mu\text{m}) \quad (1)$$

$$h \leqq 0.05\sqrt{(p_x p_y)}(\mu\text{m}) \quad (2)$$

where h denotes said height ($\mu$m) in reference to the surface of the film before heated, $p_x$ denotes a pitch ($\mu$m) in a main scanning direction, and $p_y$ denotes a pitch ($\mu$m) in a sub scanning direction.

BRIEF DESCRIPTION OF THE SEVERAL VIEWS OF THE DRAWING

This invention will be described below in detail, with reference to the drawings in which.

DETAILED DESCRIPTION OF THE INVENTION

As described before, heat sensitive stencil sheets include two kinds in view of constitution; a structure in which a film and a porous substrate are laminated together, and a single layer structure essentially consisting of a film. The following discussion does not rely on the difference in the structure of the heat sensitive stencil sheet, and relates to configuration features of desirable perforations to be formed in the film of a heat sensitive stencil sheet, a method and apparatus for producing a stencil plate having perforations with such configuration features, a heat sensitive stencil sheet, and the nature of the stencil plate produced thereby. Hereinafter, a heat sensitive stencil sheet means both a structure in which a film and a porous substrate are laminated together and a single layer structure essentially consisting of a film, without particularly distinguishing both the structures. Actually, this invention can be applied to both the heat sensitive stencil sheets of the two structures. Furthermore, hereinafter a perforated heat sensitive stencil sheet to be used for stencil printing is called a "stencil plate".

Figure 1A:
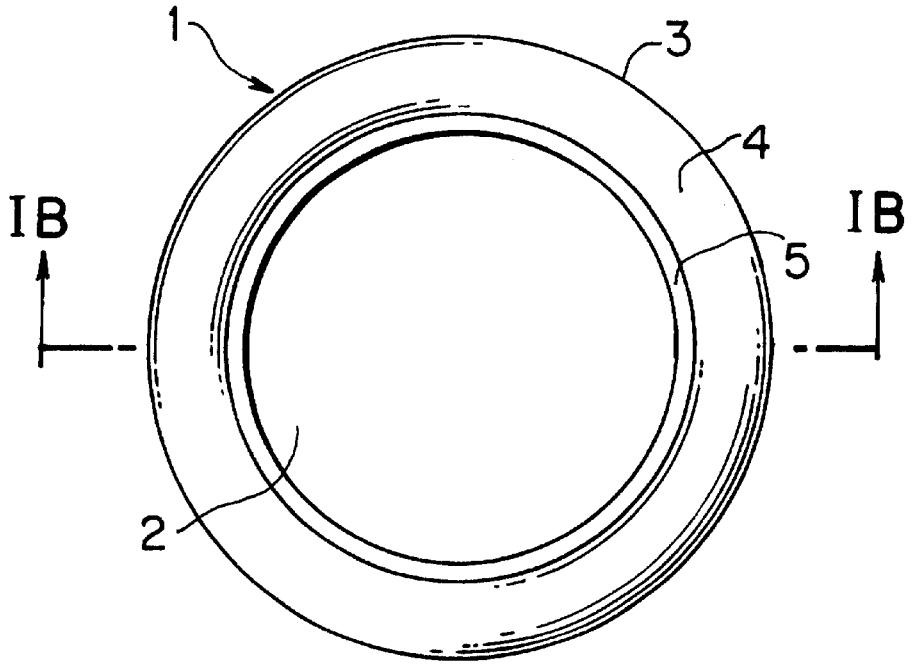
FIGS. 1A and 1B are respectively a typical plan view and a sectional view along the line IB-IB of FIG. 1A of a perforation formed in a heat shrinkable film of a heat sensitive stencil sheet.
Figure 1B:
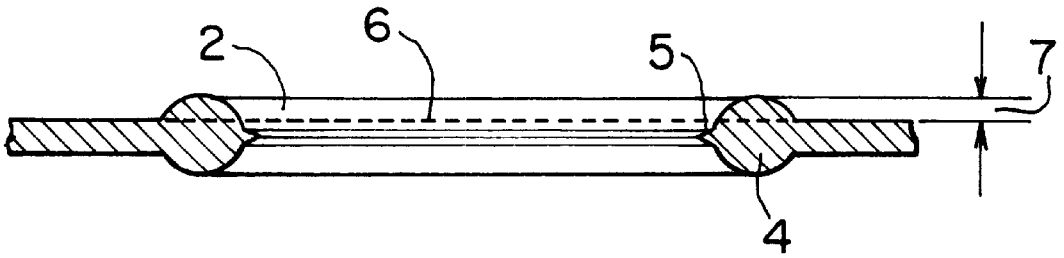

In general, each perforation 1 formed in a heat shrinkable film of a heat sensitive stencil sheet consists of, as shown in FIGS. 1A and 1B, a through portion 2 and a deformed portion 3 formed around it. This through portion 2 is hereafter called a "through hole." The deformed portion 3 formed around the through hole 2 is changed in thickness compared with the film not yet processed into a stencil plate. The deformed portion 3 generally consists of a portion 4 which is ellipsoidal in sectional form (this portion is called a "rim" in this specification), and, as the case may be, a thin film portion 5 which is in contact with the inside of the portion 4. The volume of the thin film portion 5 is very slight compared with the volume of the rim 4. Depending on a film to be used and stencil plate making conditions, it can happen that the thin film portion 5 is not formed. The rim 4 becomes thicker than the thickness of the film not yet processed into a stencil plate or of the portion not deformed by the stencil plate making process. The film surface of the portion not yet processed into a stencil plate or not deformed by the stencil plate making process, on the side to be heated by the heating device is called "the reference surface" in this specification. The maximum height 7 of the bulging of the rim in the heating device direction from the reference surface 6 is defined as the "height" of the rim in this specification. Furthermore, the whole consisting of the through hole 2 and the deformed portion 3 is called "perforation(s)" which is denoted by reference numeral 1 in this specification. The work of forming the perforation is called "perforate" or "perforation" in this specification.

In the study concerning this invention, the inventors have found a method for evaluating the perforation phenomenon from a novel point of view. That is, in the phenomenon that a heat shrinkable film is perforated by means of the thermal head that is used most generally at present among the methods for processing a heat sensitive stencil sheet into a stencil plate, behavior that each perforation is formed and expanded in the film with lapse of time has been observed in a microscope view of field on the order of $\mu$m using an apparatus capable of picking up an image at a high speed on the order of $\mu$s. As a result, it has been found that a series of perforation behavior could be divided into the following four stages.

Figure 2:
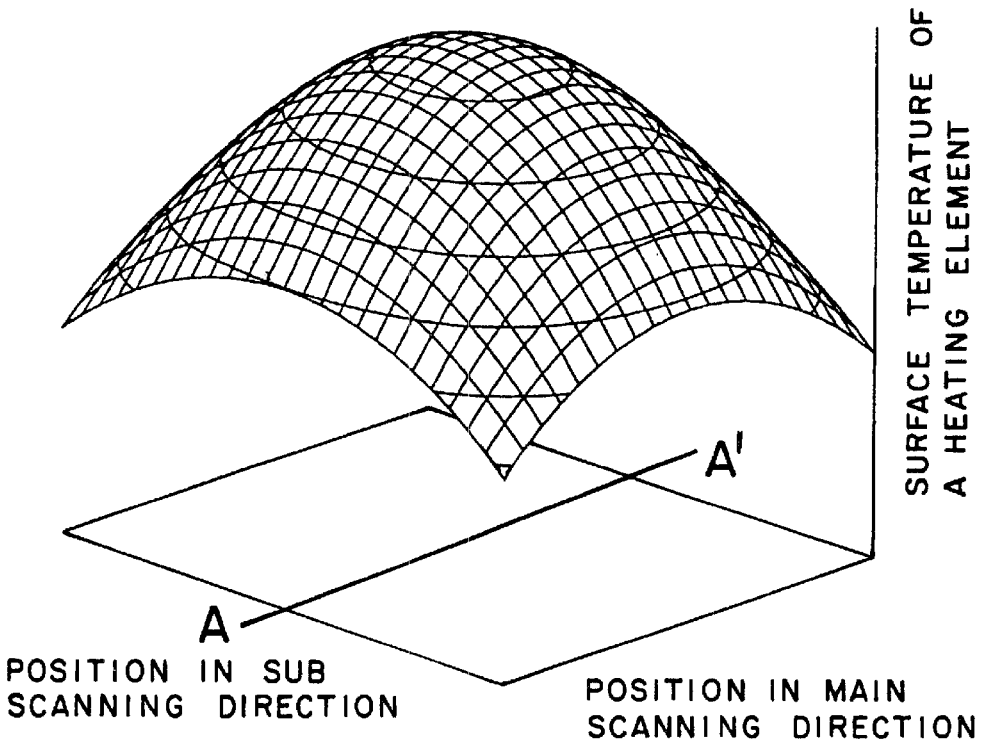
FIG. 2 is a graph showing the temperature distribution of a heating element of a thermal head.
Figure 3:
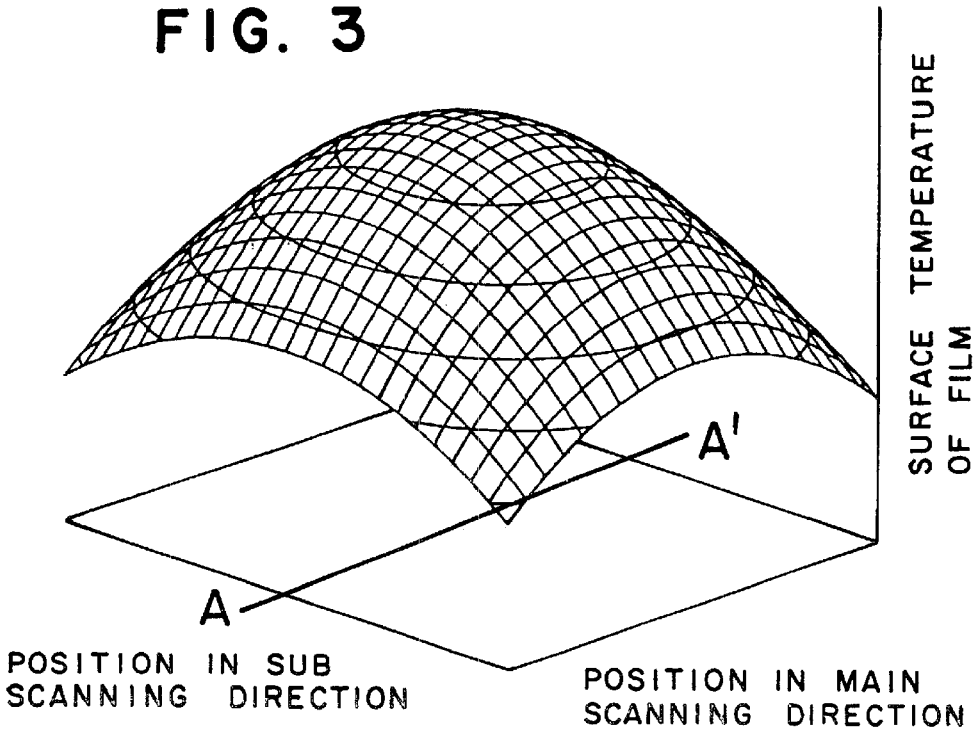
FIG. 3 is a graph showing the temperature distribution of a film heated by a heating element of a thermal head.

In the first stage, a voltage is applied to the heating elements, to generate Joule heat. As a result, each heating element of the thermal head has, as shown in FIG. 2, a temperature distribution in which the temperature is highest at the central portion and declines with increase of distance from the central portion toward periphery, and heats the film. Thus, the film has, as shown in FIG. 3, the highest temperature in the portion in contact with the center of the heating element, and the temperature declines with increase of distance from the portion. Of course, both the temperature distribution of the heating element and the temperature distribution of the film change with lapse of time.

Figure 4:
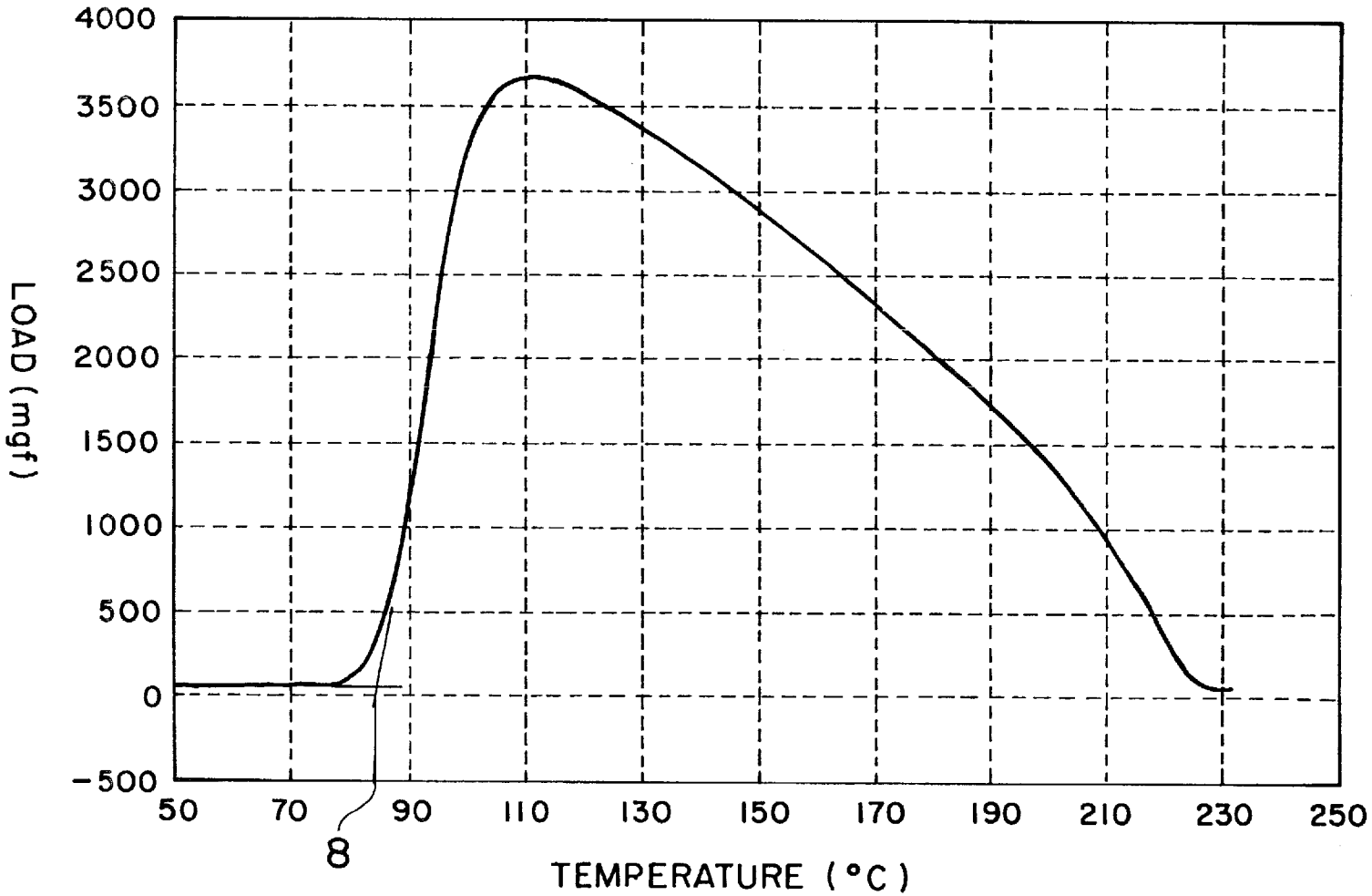
FIG. 4 is a graph showing the relation between the temperature and the heat shrinkage stress of a heat shrinkable film of a heat sensitive stencil sheet.
Figure 5:
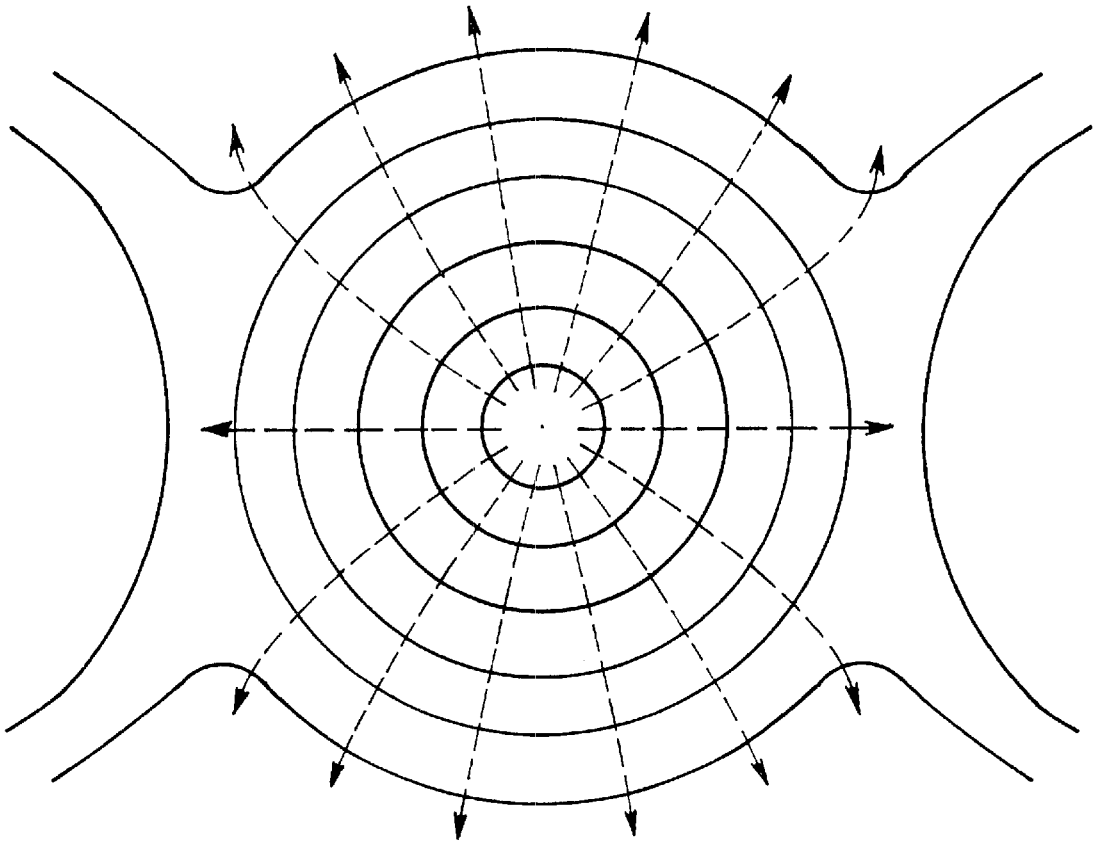
FIG. 5 is a typical plan view showing the resin migrating directions when a heat shrinkable film of a heat sensitive stencil sheet is perforated with heating.

If the film exceeds, as shown in FIG. 4, the temperature 8 at which shrinkage begins (hereinafter this temperature is called "shrinkage initiation temperature"; the shrinkage initiation temperature 8 exceeds the glass transition temperature of the film), a force for shortening mutual distance (i.e., heat shrinkage stress) occur in the planar direction of the film. So, everywhere in the region higher than the shrinkage initiation temperature 8, tensions occur. The directions of resultant forces are almost (perfectly if the thermal shrinkage is isotropic) perpendicular to the isothermal lines on the film. On the other hand, in the place where the film temperature is lower than the glass transition temperature, the resin of the film does not move, and in the place where the film temperature is higher than the glass transition temperature, deformation is more likely to occur at higher temperature portions. So, the resin of the film migrates from the highest temperature portion toward the peripheral portion, as if sliding down the slope of FIG. 3. In FIG. 5, the temperature distribution (isothermal lines) of the film occurring when heating elements adjacent in the main scanning direction generate heat is shown as solid lines, and the directions in which the temperature declines perpendicularly to the isothermal lines are indicated by dotted arrows. That is, the resin of the film migrates in the directions of the dotted lines of FIG. 5.

In the second stage, near each of the highest temperature portions of the film, a first small through hole is formed. This is the initiation of formation of a perforation.

In the third stage, the outer circumference of the formed small through hole is pulled outwardly by the tension from outside the outer circumference toward the peripheral portion. This is growth of a perforation due to heat shrinkage. The peripheral portion of the outer circumference of the through hole is expanded outwardly while taking in the resin existing on the way, to increase its volume, thus forming a rim. The sectional form of the rim is close to a circle or ellipsoid by virtue of surface tension.

In general, if a heat shrinkable film is kept in a temperature range showing heat shrinkage behavior, the film finally does not show the heat shrinkage behavior any more. In the stage of perforation growth, it is considered that the rim consists of a molten or softened resin and has accomplished heat shrinkage. Therefore, in the case where there are perforations of adjacent pixels as in a solid printed portion, if the rims of adjacent perforations contact to be merged with each other due to the growth of perforations, there are no longer any portions that pull the rims outwardly, that is, any portions where heat shrinkage is not completed. So, the rims are no longer allowed to grow perforations with heat shrinkage.

Figure 6:
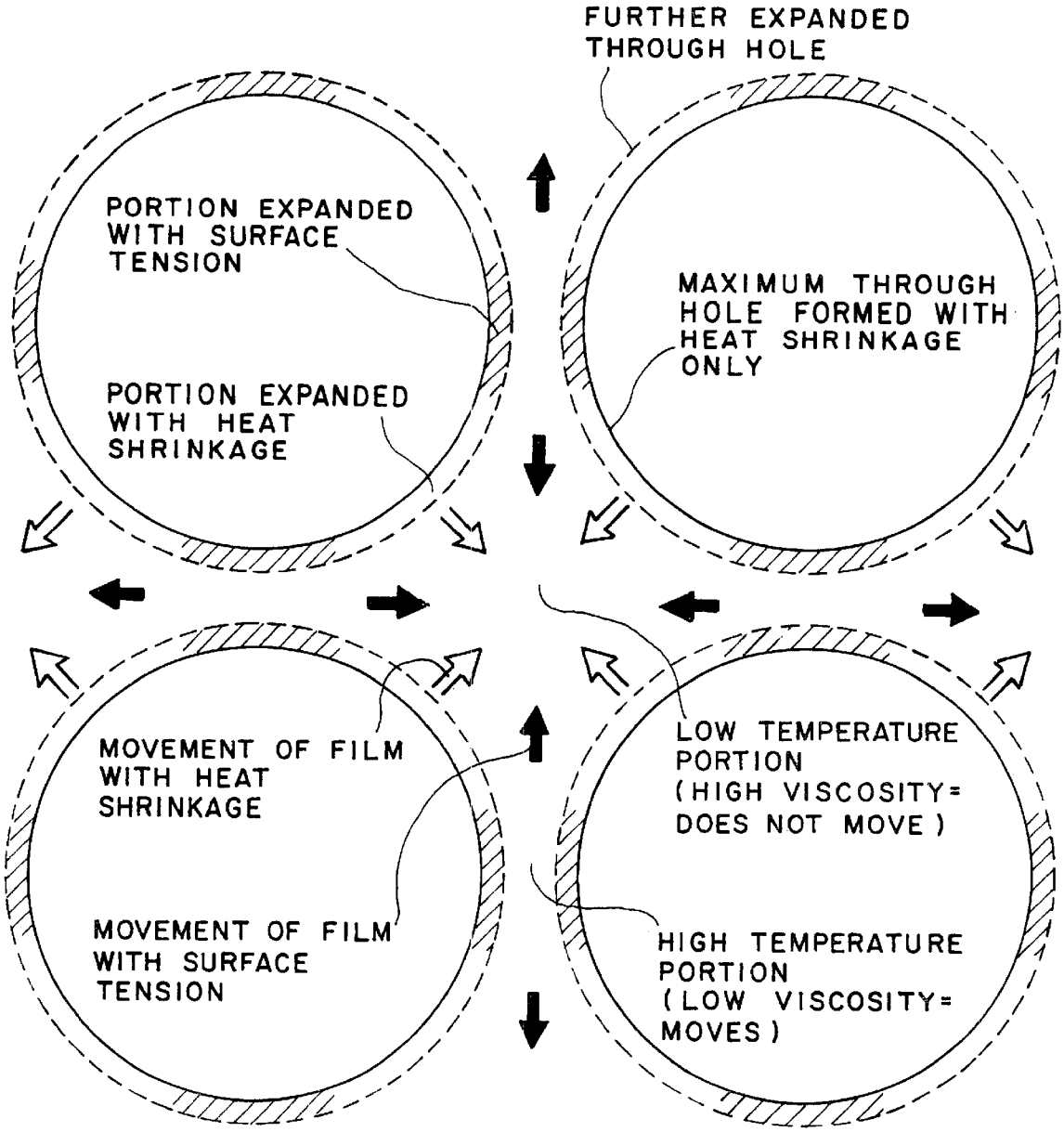
FIG. 6 is a typical plan view for illustrating the perforation behavior with heat shrinkage and hot melt of a heat shrinkable film of a heat sensitive stencil sheet.

However, for example, in the case where image dots transferred onto paper through the largest through holes expanded just by heat shrinkage were not large enough, that is, where the dot gain was small, the through holes must be further enlarged to obtain a printed matter free from any clearance between pixels, and for this purpose, it is practiced to further continue heating. In this case, though the perforations do not grow with heat shrinkage, the rims are heated and softened sufficiently, and the migration due to surface tension occurs. This phenomenon is shown in FIG. 6. The migration due to surface tension occurs from low viscosity portions (i.e., the high temperature portions located between adjacent through holes) toward high viscosity portions (i.e., the low temperature portions located between diagonally adjacent through holes). This is growth of perforations with surface tension. Since there are portions where the heat shrinkage of the film is not completed between diagonally adjacent through holes, the through holes are further expanded toward the diagonally adjacent through holes due to heat shrinkage. See the open thick arrows of FIG. 6.

In the fourth stage, with the energy application to the heating element terminated, the temperature of the heating element declines, and subsequently, the temperature of the film also declines. As a result, the temperatures of the rim and the portion outside the rim become lower than the shrinkage initiation temperature 8, and the rim is not pulled toward the peripheral portion. Furthermore, the decline in the temperature of the rim raises the viscosity, and stops the migration due to surface tension. Thus, configuration of the perforation is fixed. This is completion of the perforation.

Surface roughness of the film surface of regular heat sensitive stencil sheets presently supplied on the market for heat sensitive stencil printing machines is approximately 1 to 1.5 μm in arithmetic average roughness Ra and approximately 3.5 to 5 μm in 10-point average roughness Rz. These values are obtained by measuring an area of 10 mm×10 mm of an open (pressure-free) film surface of a heat sensitive stencil sheet tensioned on a plane at lengthwise and crosswise pitches of 30 μm at a cutoff wavelength of 2.5 mm, using a non-contact three-dimensional form measuring instrument, NH-3 (trade name) produced by Mitaka Koki K.K., and are not of the stencil sheet actually nipped between a thermal head and a platen roller in the stencil plate making process. It is considered that the surface roughness of a film of a nipped heat sensitive stencil sheet is smaller than that in an open state, but at present, any rational method for directly measuring or estimating the roughness in the nipped state is not available.

Thermal heads presently used in general for stencil plate making devices of stencil printing machines are of thin film type formed by sputtering. A feature about the structure near the heating elements of a thin film type thermal head is that the surfaces of the heating elements recede by about 1 μm from the surfaces of electrode portions adjacently disposed in the sub scanning direction. The surfaces of the electrode portions of the thermal head are closest to the film side of a heat sensitive stencil sheet, and has the arithmetic average roughness Ra of about 0.1 μm or less, and the 10-point average roughness Rz of about 0.2 μm.

The distance $d_0$ [μm] between the film surface of a nipped and non-perforated heat sensitive stencil sheet and the surfaces of the heating elements of a thermal head can be estimated as follows, though not rationally, in reference to the receding depth h of the surfaces of heating elements, 10-point average roughness $R_{zt}$ of the surfaces of the electrode portions near the heating elements of the thermal head and the 10-point average roughness $R_{zf}$ of the film surface of the heat sensitive stencil sheet:

$$h \leqq d_0 \leqq h + R_{zt} + R_{zf}$$

According to this estimation, $d_0$ is shown as $$1 \leqq d_0 \leqq (4.5 \sim 6).$$

In the case where the film of a heat sensitive stencil sheet in the portion nipped between a thermal head and a platen roller is not perforated at all, the height of rims is zero. Therefore, the distance $d_0$ [μm] between the film surface immediately before the first perforation is formed in the portion, i.e., the reference surface and the surfaces of the heating elements in contact with it depends on the forms or surface roughness of both the reference surface and the heating element surface as nipped, and can be estimated to be about $$1 \leqq d_0 \leqq (4.5 \sim 6)$$

as already described.

If the film is perforated in the stencil plate making process, perforations grow in the third stage of the above-mentioned perforation behavior, and simultaneously, the rims of the perforations are formed and become larger in cross sectional area. That is, the rims bulge. The bulging portions of rims become closer to the heating elements. Therefore, the bulging portions of rims are held between the reference surface and the heating elements.

Furthermore, in the case where the heating elements exist on the film in the portion just after the leading end of the image area in the sub scanning direction, that is, in the case where the film of the heat sensitive stencil sheet is already perforated in the portion that has just passed the heating elements and is nipped between the thermal head and the platen roller, the bulging rims of the perforations in the already perforated portion are held between the reference surface and a neighboring area of the heating elements.

These actions appear as either or both of the following two phenomena.

As the first phenomenon, the portion pulling the rim outwardly becomes farther away from the heating element by a distance corresponding to the height of the rim, compared with the most bulging portion of the rim.

To describe more accurately, as described before, the rim in the stage of perforation growth consists of a molten or softened resin. So, it may be crushed to some extent by the nip pressure. If a perforated heat sensitive stencil sheet is observed with a microscope, the crushed and deformed rims of perforations can be confirmed. According to the observation, it can happen that at the projections of the above-mentioned surface roughness of the film in the image area having substrate fibers in contact with the back portions of the projections, the rims of perforations are deformed. The deformed rims do not always become zero in height, and the heights are dispersed in a wide range of 0 to 100% of the height before deformation. The irregularity in the deformation of rims suggests that the pressure acting on the deformed portions is irregular and that the rims of perforations have some hardness to prevent that the heights do not become zero under the pressure.

Furthermore, the rims in the already perforated portion of the film that has passed the heating elements are quickly cooled and hardened, and thereafter, the rims are not deformed in height any more even if the nip pressure acts on them. When the distance between each rim and the nearest heating element in the sub scanning direction is within about 100 $\mu$m, the contact between the surfaces of the heating elements and the film surface to be perforated with the heating elements, i.e., the reference surface is prevented.

Therefore, in most of the perforated portions of the image area, the minimum value of the distance between the surfaces of heating elements and the reference surface becomes larger by a distance corresponding to the height of rims. If the height of rims is $\alpha$ [$\mu$m], the distance d [$\mu$m] between the reference surface and the surfaces of heating elements can be estimated to be approximately as follows:

$$1+\alpha \leqq d \leqq (4.5\sim 6)+\beta$$

where $\beta$ [$\mu$m] denotes the increase of the maximum value of the distance between the surfaces of heating elements and the reference surface due to the formation of rims. It is considered that $\alpha$ and $\beta$ has the following relation:

$$0 \leqq \beta < \alpha.$$

The temperature of the portion pulling each rim outwardly is lower than that in the case where it is assumed that there is no influence of rim height. That is, a problem that the heat transfer efficiency declines arises. The degree of decline is more remarkable if the rim height is higher. Thus, the third perforation stage is completed earlier to stop perforation growth.

If a sufficient heating value cannot be given to the heating elements in a state of high rims at low heat transfer efficiency, the size of perforations does not reach the desired value, and the density level of the printed matter declines.

If a sufficient heating value is given to the heating elements in a state of high rims at low heat transfer efficiency, to form perforations with the desired size, the power consumption in the stencil plate making process increases. Furthermore, if the energy application time is set to be longer, the stencil plate making time becomes also longer in general. Moreover, in the case where the temperature of the heating elements is set at a high level in the stencil plate making process, the time taken for the heating elements to reach higher than a certain temperature becomes longer, and the heating elements are likely to be deteriorated. In the case of a thermal head widely used as a heating device in the heat sensitive stencil plate making process, since the heating temperature range (300 to 400° C.) is very close to the critical service temperature (400° C.), this tendency is more remarkable.

Furthermore, as described before, the rims of perforations that have passed the heating elements are not deformed even if the nip pressure act on them, and when the distance between each rim and the corresponding heating element in the sub scanning direction is within about 100 $\mu$m, the contact between the surfaces of heating elements and the film surface to be perforated with the heating elements, i.e., the reference surface is prevented to lower the heat transfer efficiency. This phenomenon does not uniformly occur in the image, but depends on the image pattern. That is, in the respective low image rate portions such as the top portion of an image area in the sub scanning direction, the inside of a solid printed portion, fine characters portion and a gray portion of area gradation, the height of each rim formed in their position immediately before in the sub scanning direction and the area of each rim subject to the nip pressure are very different from portion to portion, and if the height of each formed rim is high, the distance between the surface of heating elements and the reference surface becomes greatly different from portion to portion. Therefore, depending on places on an image, perforations become irregular in size and the density of printed matter becomes locally irregular. Therefore, this undesirable phenomenon cannot be compensated by means of adjusting the ink viscosity or the blending proportion of coloring material, or adjusting the printing pressure for adjusting the average values of amount or density of ink transfer.

As the second phenomenon, since it is considered that the bulging resin portions of rims held between the reference surface and the heating elements have finished heat shrinkage and are in a molten or softened state under heating, they are crushed by the pressure acting in the stencil plate making process, and further deformed by the shearing stress acting with the heating elements.

The crushed bulging resin portions of rims are differently deformed because of the following reasons. The heating states of the heating elements corresponding to individual pixels or perforations are not perfectly uniform, and the surface roughness of the film gives different heat transfer distances. Furthermore, irregularity of heat shrinkage properties and heat capacities of dispersed substrate fibers, which vary depending on places in the film, are influential. These cause the perforation configuration irregularity, making the rims different in volume and hardness and causing different shearing stresses to act on the rims. In the case where the rims are high, irregularity in rim deformation, i.e., in the final perforation configuration is remarkable, and it can happen that a rim partially comes off causing the adjacent perforations to be merged with each other, or that a crushed rim resin portion partially or perfectly closes perforations adjacent in the main scanning direction or sub scanning direction. If such a stencil plate is used for printing, ink transfer irregularity in the image area becomes large. Especially a solid printed portion presents a rough feeling to lower the density uniformity. At the same time, thin characters are blurred and saturated. Furthermore, in a printed portion large in ink transfer, set-off and seep-through occur.

When the bulging resin portions of rims are crushed and deformed, it can happen that the resin of the film, the ingredient of the adhesive used for joining the film and the porous substrate and the like are fixed (or seized) on the heating elements. The film is usually coated with a releasing agent for preventing the fixing on the heating elements. However, if the rims are high, the heating value of the heating elements is increased to form through holes with an intended size. So, the temperature of the heating elements becomes high. Furthermore, since the rims are high, the film strongly contacts the heating elements and is stressed with shearing. Because of these phenomena, the resin of the rim portions and the adhesive ingredient contained in the rim portions are more likely to be fixed on the heating elements.

If the resin of the rim portions and the adhesive ingredient are fixed on the heating elements per se, it means that the heating elements decline in heating value, and perforations become small in size or perforation may become impossible. The printed matter obtained in this case becomes insufficient in density at the defectively perforated portions or causes voids in the image at the portions that failed to be perforated. Furthermore, in the case where the fixed area is large, a wide region of the film comes off from the substrate, and as a result, it can happen that the printed matter is stained as if scratched in a region downstream of the image area; namely so-called sticking occurs. As a matter of course, this causes set-off and seep-through.

Even if the resin of rim portions and the adhesive ingredient are not fixed on the heating elements per se, it can happen that they are little by little deposited on the surface of the thermal head downstream of the heating elements. The deposited resin is sticky, and though it does not pose any large problem in the initial stage, the deposit can build up with lapse of time. As a result, it can happen that the deposit stems the dirt and dust of the film surface at a position immediately after the heating elements, and that the deposit becomes huge to keep the heating elements farther away from the film, causing the perforations to be small in size or the perforation work to fail because of insufficient heat transfer. The printed matter obtained in this case also becomes insufficient in density at the defectively perforated portions and causes voids in the image at the portions that failed to be perforated.

When a heat sensitive stencil sheet is processed into a stencil plate using a thermal head, as described before, a voltage is applied to the heating elements to generate Joule heat. As a result, each heating element of the thermal head has, as shown in FIG. 2, a temperature distribution in which the central portion has the highest temperature with the temperature declining toward the periphery, when heating the film. Thus, the film has, as shown in FIG. 3, the highest temperature in the portion in contact with the center of the heating element, and the temperature declines with increase of distance from that portion. Of course, both the temperature distribution of the heating element and the temperature distribution of the film change with lapse of time.

The minimum energy required to obtain through holes with a desired size depends on perforation sensitivity of the heat sensitive stencil sheet and heat transfer efficiency of the heat sensitive stencil plate making device.

The heating elements of thin film type thermal heads that are generally used at present as a stencil plate making device in stencil printing machines contact with electrodes of aluminum in the sub scanning direction, a heat insulating layer of ceramic as an underlying layer (on the side opposite to the heat sensitive stencil sheet) and a protective layer of glass as an overlying layer (on the side facing the heat sensitive stencil sheet). Since the thickness of the protective layer is as thin as several micrometers, the heat capacity is very small compared with those of the electrodes and the heat insulating layer. From the surface of the protective layer (this has been called "the surface of the heating element" in this specification; this expression will be used in this sense also hereunder unless otherwise stated), heat is transferred to the film through an air layer having an approximate thickness of d [$\mu$m] shown in the following formula:

$$1+\alpha \leqq d \leqq (4.5\sim 6)+\beta$$

where $\alpha$ denotes the height of rims, and $\beta$ denotes increase of the maximum value of the distance between the surfaces of heating elements and the reference surface due to formation of rims, and it is considered that there is the following relation:

$$0 \leqq \beta < \alpha.$$

The heat conductivities [$Wm^{-1}K^{-1}$] of the above materials that contact the heating elements are 230 to 240 with aluminum, 1.5 with ceramic (porcelain), and 1 to 2 with glass (quartz glass) according to a literature "Chronological Table of Science (in Japanese), 1998 edition", edited by National Astronomical Observatory and published by Maruzen, and on the contrary, the heat conductivity of air is as extremely small as 0.02 to 0.07. That is, if the thickness d of the air layer is made larger even slightly due to $\alpha$, the temperature of the film declines greatly, and as described before, the heat transfer efficiency declines. To avoid it, the thickness of the air layer, i.e., the distance between the surfaces of heating elements and the reference surface must be kept as small as possible.

To keep the thickness d of the air layer small, the height $\alpha$ of rims must be kept small.

The allowable upper limit value of height $\alpha$ of rims has been experimentally examined. In the experiment, a film with a thickness of $\alpha$ was stuck as a spacer at a position near the heating elements of a thermal head but not interfering with the spread of perforations, for making a stencil plate. It was arranged such that the rims of perforations formed in the stencil plate making process did not interfere with the spacer film in the nipped region. As a result, it has been found that if the thickness $\alpha$ of the spacer film exceeded 4 $\mu$m, perforation configuration quality (average value and dispersion of through hole sizes, and dispersion of shapes) and image quality of prints (average value and dispersion of densities in an image area and blurring) were greatly deteriorated compared to the case where the spacer film was omitted at the same electric settings of the thermal head. On the contrary, when the energy applied to the thermal head was increased to let the average value of through hole sizes of perforations agree with that obtained without sticking the spacer film, the average value of through holes of perforations and the average value of densities in the image area of the printed matter were improved, but the other perforation configuration quality (dispersion of through hole sizes and the dispersion of forms) and the other image quality of the printed matter (dispersion of densities in the image area) were deteriorated after all, further aggravating set-off and seep-through.

Furthermore, it has been found that the thickness $\alpha_1$ of the spacer film that began to affect the perforation configuration quality and the image quality of prints depended on the resolution of the stencil plate making device. At 300 dpi, $\alpha_1$ was about 4 $\mu$m, at 400 dpi, about 3.2 $\mu$m, and at 600 dpi, about 2.2 $\mu$m. Furthermore, when the resolution in the main scanning direction was 300 dpi while that in the sub scanning direction was 400 dpi, $\alpha_1$ was about 3.7 $\mu$m. The values of $\alpha_1$ are equal to about 5% of the geometric mean of the pitch in the main scanning direction and the pitch in the sub scanning direction. It has been found that when the heat sensitive stencil sheet is conditioned well, that is, when the surface roughness of the film surface is small, and when the thickness $\alpha$ of the spacer film was not larger than the above value $\alpha_1$ for each resolution, almost the same perforation configuration quality and print quality as obtained without sticking the spacer film could be obtained at the same electric settings of the thermal head.

From the above, the inventors have found that if the height of rims set in a range not exceeding 4 $\mu$m and further set in a range not exceeding 5% of the geometric mean of the pitch in the main scanning direction and the pitch in the sub scanning direction, then the object of this invention can be achieved.

To set the perforation pattern as stated in the claims of this invention, the height of rims must be optimized, and arbitrary methods can be used for this purpose. The height of a rim depends on the volume of the resin in the rim portion and the oblateness of the sectional form of the rim. The volume of the resin in the rim portion depends on the volume of the resin that had existed in the place of the through hole before perforation. That is, if the thickness of the film is selected with the area of the through hole kept, the volume of the resin in the rim portion can be varied, and therefore the height of the rim can be selected. Furthermore, if a heating device is selected in terms of a spatial distribution of temperature (for example, the shape of heating elements or the applied energy of a thermal head) and a temporal change of temperature (for example, a combination of power applied to the thermal head and application time), the oblateness of the sectional form of the rim can be varied, and therefore the height of the rim can be selected.

In the above description, the heating elements of a thermal head have been often referred to as a heating device, but since this invention can be generally applied to the phenomena of perforating a heat shrinkable film with heating, the heating device is not limited to a thermal head. In this invention, a laser beam source, active energy source and many other devices can be used as a heating device.

DESCRIPTION OF THE PREFERRED EMBODIMENT

Examples

This invention is described below based on examples and comparative examples. The stencil plate making conditions, measured values of perforation configurations, evaluation of perforations and evaluation of prints in the respective examples and comparative examples are shown in Table 1. The methods for measuring the physical properties shown in Table 1 were as follows.

Stencil Evaluation Conditions

In the examples and comparative examples, each stencil was prepared using an experimental stencil plate making device and a heat sensitive stencil sheet which respectively satisfied the respective conditions (i.e., resolution, pitch, heating element size, applied energy, periods, physical properties of film) shown in Table 1. The other common conditions of the heat sensitive stencil sheet were as follows. As for materials, various polyester resins different in mixing ratio were biaxially oriented to form films having a thickness and melting point shown in Table 1. Each of the films and 35 $\mu$m thick mixed paper with a unit weight of 10 g/m$^2$ consisting of Manila hemp and polyester fibers as a porous substrate were laminated with 0.5 g/m$^2$ of polyvinyl acetate resin kept between them, and the film surface was coated with 0.1 g/m$^2$ of a silicone resin, to prepare a heat sensitive stencil sheet. The environmental temperature was room temperature.

Value of min{4, 0.05√($p_x$, $p_y$)}

This shows the value of the smaller of the right side of formula (1) or the right side of formula (2). In this invention, it is especially preferable that the height of rims is not larger than this value.

Surface Roughness of Film Surface of Heat Sensitive Stencil Sheet

As the surface roughness of the film surface of a heat sensitive stencil sheet, the arithmetic average roughness Ra and 10-point average roughness Rz were obtained by measuring an area of 10 mm×10 mm of an open (pressure-free) film surface of a heat sensitive stencil sheet tensioned on a plane at lengthwise and crosswise pitches of 30 $\mu$m at a cutoff wavelength of 2.5 mm, using a non-contact three-dimensional form measuring instrument, NH-3 (trade name) produced by Mitaka Koki K.K. The arithmetic average roughness Ra and the 10-point average roughness Rz are as defined in JIS B 0601 "Surface Roughness—Definitions and Indications,".

Diameter of Through Holes, Height of Rims

Stencil plates having solid pattern were prepared. The surface roughness of perforations of stencil plates in regions similar in heat history state (specifically, regions within 5 mm to 15 mm in the sub scanning direction downstream from the plate-making initiation line) was measured using a scanning type laser microscope, 1LM21 (trade name) produced by Laser Tec K.K., and the diameters of through holes and the heights of perforations in the main scanning direction and the sub scanning direction were obtained as average values of 20 perforations.

SN Ratio of Areas of Through Holes

Stencil plates having solid pattern were prepared. From images of the stencil plates in regions similar in heat history state (specifically, region within 5 mm to 15 mm in the sub scanning direction downstream from the plate-making initiation line) taken by a CCD camera through an optical microscope, through holes of 100 perforations were cut out by means of binarization using Image Analyzer Package MacSCOPE (trade name) produced by Mitani Shoji K.K., and the SN ratio of the areas of the through holes was obtained therefrom.

The SN ratio of areas of the through holes is on the "nominal the best" basis. If this value is larger, the perforated areas are less irregular. The SN ratio of perforated areas depends on measuring conditions and is difficult to evaluate simply. Empirically the inventors consider that in order to achieve uniformity in state of transfer from the respective perforations, 10 db or more is realistically necessary, and 13 db or more is desirable, and the SN ratio of less than 10 db is troublesome.

Printed Matter Evaluation Conditions

In the examples and comparative examples, the obtained stencil plate was manually installed around the printing drum for printing using a stencil printing machine, RISOGRAPH (registered trademark) GR377 brand machine produced by Riso Kagaku Corporation, under the standard conditions (i.e. ,the default settings when the power was turned on) and RISOGRAPH Ink GR-HD (tradename, produced by Riso Kagaku Corporation) brand ink. The environmental temperature was room temperature (25° C.).

Uniformity of Solid Printed Portions

As for the uniformity of solid printed portions, degree of density irregularity in microscopic places (at intervals of about 1 mm or less) caused by perforation configuration irregularity in solid printed portions of prints was subjectively evaluated according to the following criterion:

◎: Density irregularity was not felt at all.

○: Density irregularity was slightly observed, but both solid reproducibility of characters and tone reproducibility of photographs were on practical levels.

Δ: Solid reproducibility of characters was on a practical level, but tone reproducibility of shadow portions of photographs was poor.

X: Density irregularity was remarkable, and both solid reproducibility of characters and tone reproducibility of photographs were poor.

Blurring of Fine Characters

As for the blurring of fine characters, degree of blurring (e.g., partial lack of continuous lines) caused by perforation configuration irregularity in fine characters portions of prints was subjectively evaluated according to the following criterion:

◎: Blurring was not felt at all.

○: Slight blurring was observed, but both reproducibility of fine characters (black characters on white background) and tone reproducibility of highlight portions of photographs were on practical levels.

Δ: Reproducibility of fine characters (black characters on white background) was on a practical level, but tone reproducibility of highlight portions of photographs was poor.

X: Blurring was remarkable, and both reproducibility of fine characters (black characters on white background) and tone reproducibility of highlight portions of photographs were poor.

Saturation of Fine Characters

As for the saturation of fine characters, degree of saturation (partial lack of a blank that should exist between nearby two character lines) caused by perforation configuration irregularity was subjectively evaluated according to the following criterion:

◎: Saturation was not felt at all.

○: Slight saturation was observed, but both reproducibility of fine characters (white characters on black background) and tone reproducibility of shadow portions of photographs were on practical levels.

Δ: Reproducibility of fine characters (white characters on black background) was on a practical level, but tone reproducibility of shadow portions of photographs was poor.

X: Saturation was remarkable, and both reproducibility of fine characters (white characters on black background) and tone reproducibility of shadow portions of photographs were poor.

Set-off

As for the set-off, degree of stain caused by ink transferred from a printed surface of one print to the back side of another print placed on the one print immediately after printing was subjectively evaluated according to the following criterion:

◎: Set-off was not felt at all.

○: Slight set-off was observed, but prints obtained from an original with a large solid printed portion, hence large in ink transfer were on a practical level, and they could be used as official prints.

Δ: Prints were on a practical level at portions small in ink transfer such as fine characters (black characters on white background) and highlight portions, but stain was outstanding at portions large in ink transfer such as large solid printed portions. The prints could be used as unofficial prints, but could not be used as official prints.

X: Set-off was remarkable. Stain was outstanding at almost all printed portions. The prints could not be used even as unofficial prints.

Influence on Thermal Head

The influence on a thermal head refers to the extent to which the resin of the film and the adhesive ingredient are fixed or seized near the heating elements, and the extent to which the heating elements are deteriorated (i.e., the heating capacity declines) due to excessively applied energy and the overheat of the heating elements. Five hundred stencil plates with a test pattern image of B4 size with an image rate of 33% were obtained and used for printing for evaluation of state of stencil plate and quality of print. Furthermore, state of thermal head near the heating elements was observed with an optical microscope. The criterion was as follows:

◎: No change was found in state of stencil plate, quality of print and state of thermal head between the initial and $500^{th}$ trials.

○: Some deposits were observed near the heating elements, but were slight, and no change was found in state of stencil plate and quality of print between the initial and $500^{th}$ trials.

Δ: Deposits were observed near the heating elements, and deterioration of state of stencil plate and quality of print was found in the $500^{th}$ trial, compared with the initial trail.

X: Many deposits were observed near the heating elements or the heating elements were deteriorated to lower the heating capacity, and considerable deterioration of state of stencil plate and quality of print was found in the $500^{th}$ trial, compared with the initial trial.

Comparative Example 1

A heat sensitive stencil sheet was processed into a stencil plate at resolutions of 300 dpi in both the main scanning direction and the sub scanning direction with the targeted inner diameters of through holes as 60 μm in both the main scanning direction and the sub scanning direction, and the stencil plate was used for printing.

In this case, the height of rims was larger than the value of formula (1), and did not satisfy either formula (1) or (2).

Example 1

A stencil plate was prepared and used for printing as described for Comparative Example 1, except that the thickness of the film was made thinner to 3.5 μm compared to 4.5

μm of Comparative Example 1, and that the applied energy was correspondingly made smaller. As a result, the volume of the resin that had existed in the place of each through hole decreased, and the height of rims decreased.

In this case, the height of rims satisfied both formulae (1) and (2).

Example 2

A stencil plate was prepared and used for printing as described for Comparative Example 1, except that the thickness of the film was made smaller to 1.7 μm compared to 4.5 μm of Comparative Example 1, and that the applied energy was correspondingly made smaller. As a result, the volume of the resin that had existed in the place of each through hole decreased, and the height of rims decreased.

In this case, the height of rims satisfied both formulae (1) and (2).

Comparative Example 2

A heat sensitive stencil sheet was processed into a stencil plate at a resolution of 300 dpi in the main scanning direction, at a resolution of 400 dpi in the sub scanning direction, with the targeted diameter of through holes as 59 μm in the main scanning direction and the targeted diameter of through holes as 44 μm in the sub scanning direction, and the stencil plate was used for printing.

In this case, the height of rims in the main scanning direction was larger than the value of formula (2) and did not satisfy formula (2).

Example 3

A stencil plate was prepared and used for printing as described for Comparative Example 2, except that the thickness of the film was made thinner to 1.7 μm compared to 4 μm of Comparative Example 2, and that the applied energy was correspondingly made smaller. As a result, the volume of the resin that had existed in the place of each through hole decreased, and the height of rims decreased.

In this case, the height of rims satisfied both formulae (1) and (2).

Comparative Example 3

A heat sensitive stencil sheet was processed into a stencil plate at resolutions of 400 dpi in both the main scanning direction and the sub scanning direction, with the targeted diameters of through holes as 42.5 μm in both the main scanning direction and the sub scanning direction, and the stencil plate was used for printing.

In this case, the height of rims in the main scanning direction was larger than the value of formula (2) and did not satisfy formula (2).

Example 4

A stencil plate was prepared and used for printing as described for Comparative Example 3, except that the thickness of the film was made smaller to 2.5 μm compared to 4 μm of Comparative Example 3, and that the applied energy was correspondingly made smaller. As a result, the volume of the resin that had existed in the place of each through hole decreased, and the height of rims decreased.

In this case, the height of rims satisfied both formulae (1) and (2).

Example 5

A stencil plate was prepared and used for printing as described for Comparative Example 3, except that the thickness of the film was made smaller to 1.7 μm compared to 4 μm of Comparative Example 3, and that the applied energy was correspondingly made smaller. As a result, the volume of the resin that had existed in the place of each through hole decreased, and the height of rims decreased.

In this case, the height of rims satisfied both formulae (1) and (2).

Comparative Example 4

A heat sensitive stencil sheet was processed into a stencil plate at resolutions of 600 dpi in both the main scanning direction and the sub scanning direction with the targeted inner diameters of through holes as 26 μm in both the main scanning direction and the sub scanning direction, and the stencil plate was used for printing.

In this case, the height of rims in the main scanning direction was larger than the value of formula (2) and did not satisfy formula (2).

Example 6

A stencil plate was prepared and used for printing as described for Comparative Example 4, except that the thickness of the film was made smaller to 1.7 μm compared to 3.5 μm of Comparative Example 4, and that the applied energy was correspondingly made smaller. As a result, the volume of the resin that had existed in the place of each through hole decreased, and the height of rims decreased.

In this case, the height of rims satisfied both formulae (1) and (2).

TABLE 1

| | | | | Comparative Example 1 | Example 1 | Example 2 | Comparative Example 2 | Example 3 | Comparative Example 3 | Example 4 | Example 5 | Comparative Example 4 | Example 6 |
|---|---|---|---|---|---|---|---|---|---|---|---|---|---|
| Main scanning direction | Resolution | | dpi | 300 | 300 | 300 | 300 | 300 | 400 | 400 | 400 | 600 | 600 |
| | Pitch | $p_x$ | μm | 84.7 | 84.7 | 84.7 | 84.7 | 84.7 | 63.5 | 63.5 | 63.5 | 42.3 | 42.3 |
| | Diameter of through holes[1] | | μm | 61.7 | 58.6 | 61.2 | 57.2 | 61 | 43.8 | 43 | 43.9 | 26.5 | 26.4 |
| | Height of rims[1,2] | | μm | 4.17 | 2.84 | 1.91 | 3.74 | 1.89 | 3.29 | 2.15 | 1.65 | 2.32 | 1.27 |
| Sub scanning direction | Resolution | | dpi | 300 | 300 | 300 | 400 | 400 | 400 | 400 | 400 | 600 | 600 |
| | Pitch | $p_y$ | μm | 84.7 | 84.7 | 84.7 | 63.5 | 63.5 | 63.5 | 63.5 | 63.5 | 42.3 | 42.3 |
| | Diameter of through holes[1] | | μm | 60.8 | 59.2 | 59.8 | 42.9 | 44.4 | 42.7 | 41 | 41.9 | 26.9 | 25.8 |
| | Height of rims[1,2] | | μm | 4.12 | 2.88 | 1.89 | 3.25 | 1.6 | 3.25 | 2.08 | 1.59 | 2.32 | 1.27 |

TABLE 1-continued

| | | | | Comparative Example 1 | Example 1 | Example 2 | Comparative Example 2 | Example 3 | Comparative Example 3 | Example 4 | Example 5 | Comparative Example 4 | Example 6 |
|---|---|---|---|---|---|---|---|---|---|---|---|---|---|
| Value of claims | min { 4,0.05√($p_x p_y$)} | | | 4 | 4 | 4 | 3.67 | 3.67 | 3.18 | 3.18 | 3.18 | 2.12 | 2.12 |
| Conditions of heat sensitive stencil sheet | Thickness of film | | μm | 4.5 | 3.5 | 1.7 | 4 | 1.7 | 4 | 2.5 | 1.7 | 3.5 | 1.7 |
| | Arithmetic average roughness of film surface | $R_a$ | μm | 1.41 | 1.37 | 1.42 | 1.2 | 1.45 | 1.5 | 1.11 | 1.27 | 1.02 | 1.47 |
| | 10-point average roughness of film surface | $R_z$ | μm | 4.83 | 4.44 | 4.89 | 3.79 | 4.67 | 4.68 | 3.65 | 4.05 | 3.56 | 4.57 |
| Stencil plate making conditions | Size of heating elements[3] | | μm | 45 × 60 | 45 × 60 | 45 × 60 | 45 × 45 | 45 × 45 | 30 × 40 | 30 × 40 | 30 × 40 | 20 × 25 | 20 × 25 |
| | Power | | mW | 190 | 190 | 200 | 160 | 170 | 110 | 115 | 120 | 72 | 76 |
| | Application time | | μs | 685 | 580 | 360 | 720 | 400 | 730 | 520 | 400 | 555 | 340 |
| | Applied energy | | μJ | 130.2 | 110.2 | 72 | 115.2 | 68 | 80.3 | 59.8 | 48 | 40 | 25.8 |
| | Periods | | ms | 4 | 3.5 | 2.5 | 4 | 2.5 | 4 | 3 | 2.5 | 3.5 | 2 |
| Evaluation of perforations | SN ratio of areas of through holes | | db | 8.3 | 10.6 | 13.6 | 8 | 13.2 | 7.7 | 10.5 | 13 | 6.8 | 12.2 |
| Evaluation of prints | Uniformity of solid printed portion | | | X | ○ | ◎ | X | ◎ | X | ○ | ◎ | X | ◎ |
| | Blurring of fine characters | | | Δ | ○ | ◎ | Δ | ◎ | Δ | ○ | ◎ | X | ○ |
| | Saturation of fine characters | | | X | ○ | ○ | X | ○ | Δ | ○ | ◎ | Δ | ◎ |
| | Set-off | | | X | ○ | ○ | X | ○ | X | ○ | ◎ | Δ | ◎ |
| | Influence on thermal head | | | X | ○ | ◎ | Δ | ◎ | Δ | ○ | ◎ | X | ◎ |

Note 1: Average value
Note 2: Value on a side free from adjacent perforations
Note 3: Main scanning direction × Sub scanning direction According to this invention, the film of heat sensitive stencil sheets is perforated for stencil printing using a heating device such as a thermal head in such a manner that does not require the heating device to have high energy or high temperature, but prevents decline of heat transfer efficiency, improves the stencil making conditions (e.g., provides lower power consumption, shorter stencil making time and prevention of deterioration of heating elements), and lessens perforation configuration irregularity while keeping size of perforations adequate. Hence, this invention provides the film with a perforation pattern which improves quality of printed images (e.g., decreases density irregularity of solid printed portions, decreases blurring and saturation of fine characters, and decreases set-off and seep-through), and prevents a molten resin of the film from being deposited on heating elements of the thermal head.

What is claimed is:

1. A method for producing a stencil plate, which comprises providing a heat sensitive stencil sheet having a heat shrinkable film, and selectively heating said film with a heating device to form independent dot perforations corresponding to an image in said film, so that each of said perforations has a through hole and a rim surrounding said through hole and bulging on a heated side of said film, and said rim has a height that satisfies the following formulae (1) and (2):

$$h \leqq 4(\mu m) \quad (1)$$

$$h \leqq 0.05\sqrt{(p_x p_y)}(\mu m) \quad (2)$$

where h denotes said height (μm) in reference to the surface of the film before heated, $p_x$ denotes a pitch (μm) in a main scanning direction of said heating device, and $p_y$ denotes a pitch (μm) in a sub scanning direction of said heating device.

2. A method according to claim 1, wherein said heat sensitive stencil sheet comprises said film and a porous substrate, which are laminated together.

3. A method according to claim 2, wherein said film is one that is formed by biaxially orienting polyester resin.

4. A method according to claim 2, wherein said porous substrate comprises mixed paper.

5. A method according to claim 4, wherein said porous substrate consists of Manila hemp and polyester fibers.

6. A method according to claim 5, wherein a silicone resin is coated on the surface of the film.

7. A method according to claim 1, wherein said heat sensitive stencil sheet comprises a single layer structure consisting essentially of a film.

8. A method according to claim 1, wherein said heating device is a thermal head.

9. A method according to claim 8, wherein said thermal head has a pixel density of 300 to 600 dpi.

* * * * *